United States Patent [19]

Morgan

[11] Patent Number: 4,951,944

[45] Date of Patent: Aug. 28, 1990

[54] ADJUSTABLE BASKETBALL GOAL

[76] Inventor: William K. Morgan, Rte. 1, Box 326, Hughes Springs, Tex. 75656

[21] Appl. No.: 328,676

[22] Filed: Mar. 27, 1989

[51] Int. Cl.[5] ..... A63B 63/08

[52] U.S. Cl. ..... 273/1.5 R

[58] Field of Search ..... 273/1.5, 55; 52/720, 52/118; 254/98, 100–103

[56] References Cited

U.S. PATENT DOCUMENTS

| | | | |
|---|---|---|---|
| 2,307,317 | 1/1943 | Konig | 74/424.8 |
| 2,916,288 | 12/1959 | Chervenka | 273/1.5 |
| 2,986,395 | 5/1961 | Sheftel | 273/1.5 R |
| 4,395,040 | 7/1983 | White | 273/1.5 R |
| 4,522,394 | 6/1985 | Broussard | 273/1.5 |

*Primary Examiner*—Edward M. Coven

*Assistant Examiner*—Paul R. Harrison

*Attorney, Agent, or Firm*—John M. Harrison

[57] ABSTRACT

An adjustable basketball goal which is characterized in a preferred embodiment by a vertical mount pipe secured to the ground, playing surface or other foundation, a sleeve pipe telescopically seated on the mount pipe in slidable relationship, with a rim-equipped backboard attached to the upper end of the sleeve pipe, and a linear actuator having a drive end secured to the ground, playing surface or other foundation and the opposite end attached to the sleeve pipe, such that operation of the linear actuator raises and lowers the sleeve pipe on the mount pipe, in order to adjust the backboard and rim to a selected height above the ground or playing surface.

9 Claims, 1 Drawing Sheet

ADJUSTABLE BASKETBALL GOAL

BACKGROUND OF THE INVENTION

1. Field of the Invention

This invention relates to adjustable basketball goals and more particularly, to an adjustable basketball goal which is characterized in a preferred embodiment by a mount pipe fixedly attached to a supporting surface in substantially vertical relationship, a sleeve pipe slidably and telescopically positioned on the mount pipe, with a basketball goal backboard and rim secured to the top end of the sleeve pipe and a linear actuator having a drive shaft fixedly attached to the supporting surface and an actuator shaft secured to the sleeve pipe. Raising and lowering the sleeve pipe with respect to the mount pipe is facilitated by operation of the actuator to adjust the height of the backboard and the rim above the supporting surface.

One of the problems which exist with conventional adjustable basketball goals is the facility for rapidly and efficiently adjusting the basketball goal rim precisely to a selected height above the playing surface. The capability for adjusting the rim height above the playing surface is necessary, or at least desirable, since players of varying age and height must frequently use the same basketball facilities. Accordingly, adjustment of the height of the backboard and more specifically, the rim, of the basketball goal is useful, in order to better develop the playing skills of players of various age and height.

2. Description of the Prior Art

Various types of adjusting mechanisms are known in the art for adjusting the height of basketball backboards and rims. A popular system for gymnasiums and assembly centers which are frequently used for purposes other than basketball games, is the "swing" type backboard mount, wherein the backboard is pivotally suspended from the ceiling or walls of the structure and is raised and lowered by operation of a cable and winch or drum system. The raising and lowering procedure in such systems is usually slow and cumbersome and requires considerable effort to implement. However, these systems can be automated, as described in the "Automatic Hoist System for Backstop Assembly", detailed in U.S. Pat. No. 3,452,984, dated July 1, 1969, to J. M. Miller, et al. The system includes a backboard provided with a rim and net, which backboard is pivotally suspended from the ceiling of a structure and is raised and lowered by means of an automatic hoist and cable system. U.S. Pat. No. 3,329,427, dated July 4, 1967, to D. A. Bearson, details an "Adjustable Basketball Goal", wherein the backboard is mounted to a generally Z-shaped bracket that is slidably attached to the vertical basketball goal support. One end of a cable is secured to the top member of the Z-shaped bracket and the cable is extended over a pulley located at the top of the support and downwardly to a hook positioned approximately midway of the height of the support. Vertical adjustment of the basketball goal backboard and rim above the playing surface is facilitated by raising and lowering the Z-shaped bracket using the cable. A "Vertically Adjustable Basketball Goal" is detailed in U.S. Pat. No. 3,427,025, dated Feb. 11, 1969, to E. H. Procter. The adjustable mechanism includes a vertically-oriented base member provided with a telescoping receiving member, with a crank mechanism mounted on the base member in cooperation with the receiving member for raising and lowering the receiving member with respect to the base member. The backboard and rim are attached to the upper end of the receiving member and are adjusted vertically by operation of the crank. U.S. Pat. No. 3,477,714, dated Nov. 11, 1969, to W. M. Garlington, details a "Basketball Backboard and Horizontally Movable Basket". The apparatus detailed in this patent includes a screw-type mechanism which is horizontally attached to the backboard and receives the basketball rim for horizontally and adjustably moving the rim from side-to-side along the backboard to a selected position. U.S. Pat. No. 2,313,188, dated Mar. 9, 1943, to C. C. Woodburn, details an "Adjustable Goal for Basketball Courts". The adjustable goal is characterized by a rim-equipped backboard attached to the extending ends of a pair of parallel frame members having a brace extending therebetween, in order to adjust the frame members upwardly and downwardly at hinged attachment points to a vertical upright or a wall and change the height of the basketball rim. A "Collapsible Movable Apparatus for Supporting Health-Sports Devices" is detailed in U.S. Pat. No. 4,522,394, dated June 11, 1985. The device includes a telescoping post support having at least two telescoping segments and a ratchet device for moving each of the adjacent telescoping segments with respect to each other. Another support is adapted to fit slidably on the top telescoping segment without overlapping onto the next telescoping segment. A large, horizontally positioned ring is mounted on the support and a platform is pivotally mounted under the ring, such that the platform is able to swing downwardly when unconnected from the ring. A basketball backboard is vertically mounted to the top portion of the top telescoping segment and the bottom end of the telescoping post is adapted to fit into a tube positioned in the ground or other horizontal surface.

It is an object of this invention to provide an adjustable basketball goal which is characterized by precise, vertical adjustment of a backboard and rim support member with respect to a fixed mount member, by operation of a linear actuator.

Another object of the invention is to provide an adjustable basketball goal which includes a mount pipe fitted with an outer telescoping sleeve pipe that mounts a backboard and rim, and an actuator mechanism attached to the sleeve pipe to facilitate raising and lowering the sleeve pipe and corresponding precise vertical positioning of the backboard and rim above a playing surface.

Still another object of the invention is to provide an adjustable basketball goal which is characterized by a mount pipe fixedly secured to a horizontal surface, a backboard and rim-supporting sleeve pipe fitted concentrically and slidably over the mount pipe and a linear actuator having a shaft element attached to the sleeve pipe and a drive element mounted on the horizontal surface and engaging the shaft element in extensible and retractable relationship, for precise adjustment of the backboard and rim above a playing surface by operation of the linear actuator.

Yet another object of this invention is to provide an adjustable basketball goal which is characterized by a vertically-oriented mount member having one end fixedly attached to a frame, a horizontal receiving surface or directly on the playing surface; an adjustable backboard support member fitted to the mount member in slidable relationship and a backboard and rim attached to the adjustable member; and a linear actuator having a drive element attached to the frame or the horizontal receiving or playing surface and an actuator shaft attached to the adjustable member, for automatically adjusting the height of the adjustable member, the backboard and the rim with respect to the playing surface by operation of the linear actuator.

SUMMARY OF THE INVENTION

These and other objects of the invention are provided in a new and improved adjustable basketball goal which is characterized in a most preferred embodiment by a vertically-oriented mount pipe fixedly attached to a horizontal surface adjacent to the playing surface; a backboard support sleeve pipe concentrically and slidably fitted on the mount pipe, with a backboard and rim attached to the upper end of the sleeve pipe; and a linear actuator having a drive shaft pivotally secured to the horizontal surface and an actuator shaft attached to the sleeve pipe and adapted to receive the drive shaft in extensible and retractable relationship, such that operation of the linear actuator raises and lowers the sleeve pipe on the mount pipe and vertically adjusts the backboard and rim with respect to the horizontal surface.

BRIEF DESCRIPTION OF THE DRAWING

The invention will be better understood by reference to the accompanying drawing, wherein.

DESCRIPTION OF THE PREFERRED EMBODIMENTS

Figures 1, 2, 3:
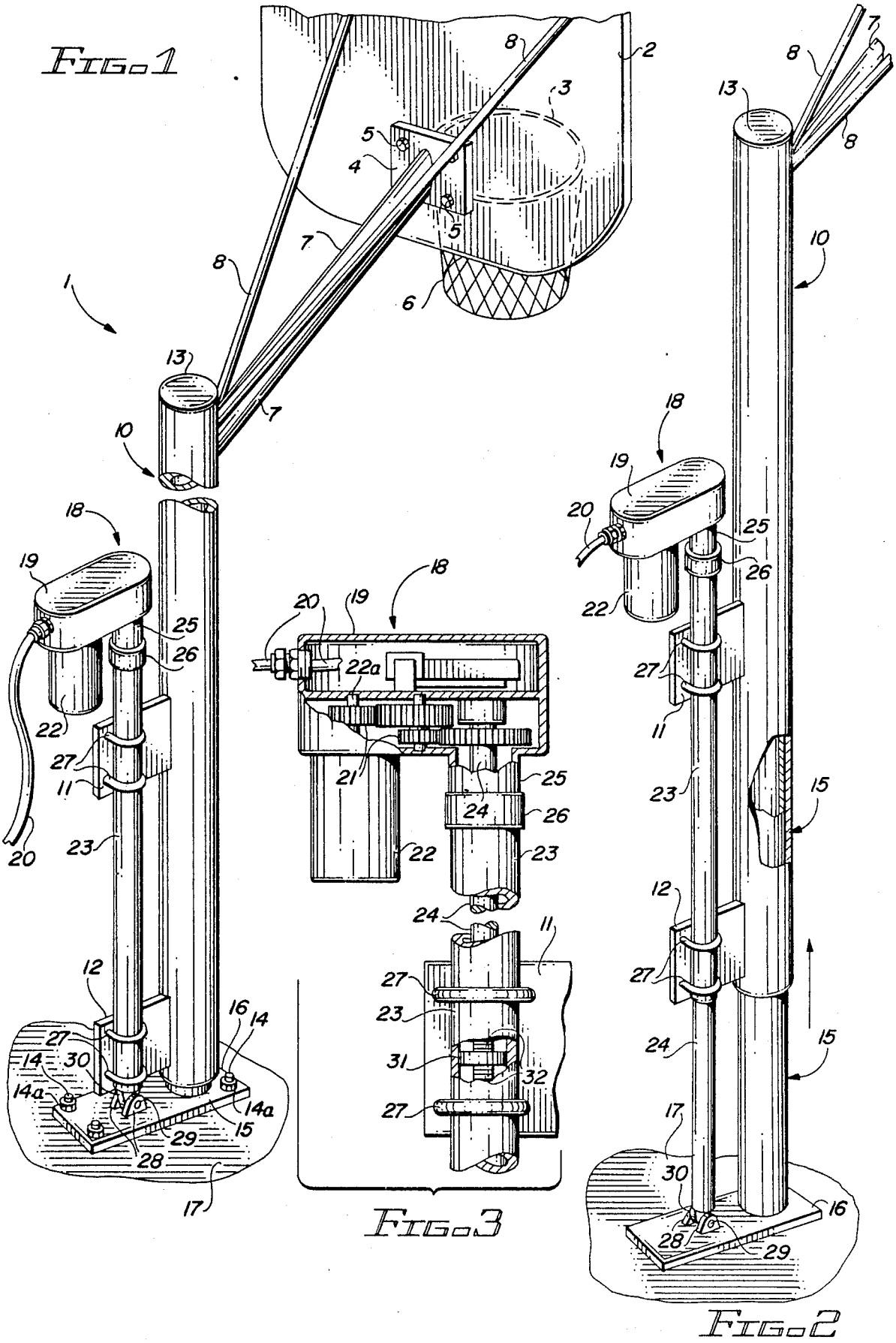
FIG. 1 is a perspective view of the adjustable basketball goal of this invention with the backboard support pipe, backboard and rim telescopically lowered with on the mount pipe.
FIG. 2 is a perspective view, partially in section, of the adjustable basketball goal illustrated in FIG. 1, with the backboard support sleeve pipe, backboard and rim telescopically raised with respect to the mount pipe.
FIG. 3 is a side view, partially in section, of a typical linear actuator mechanism for raising and lowering the sleeve pipe, backboard and rim with respect to the mount pipe.

Referring initially to FIG. 1 of the drawing, the adjustable basketball goal of this invention is generally illustrated by reference numeral 1 and is characterized by a tubular mount pipe 15 having one end welded or otherwise secured to a base plate 16, mounted on a horizontal surface 17. The base plate 16 is anchored to the horizontal surface 17 by any suitable means, such as anchor bolts 14 and cooperating nuts 14*a*, as illustrated in FIG. 1, which anchor bolts 14 are embedded in the horizontal surface 17, according to the knowledge of those skilled in the art. This anchoring technique is particularly well suited to mounting the base plate 16 to a concrete horizontal surface 17. A tubular sleeve pipe 10 is concentrically fitted over the mount pipe 15 and is characterized by a sleeve pipe cap 13 closing the upper end thereof. A backboard 2 is attached to the upper end of the sleeve pipe 10 by means of a backboard support 7 and backboard braces 8 and a rim 3 is attached to the backboard 2 in conventional fashion, typically by means of a rim bracket 4 and bracket bolts 5. A net 6 is extended from the rim 3. The sleeve pipe 10 is further provided with an outwardly- extending top sleeve pipe plate 11 and a bottom sleeve pipe plate 12, each of which are welded or otherwise attached to the sleeve pipe 10 in vertically spaced relationship. The actuator shaft 23 and drive shaft 24 elements of a linear actuator 18 are vertically aligned with the sleeve pipe 10 and the mount pipe 15 and the actuator 18 is further characterized by an actuator housing 19, mounted on the top end of the actuator shaft 23, with wiring 20 extending therefrom for operational purposes, as hereinafter further described. An electric motor 22 is carried by one end of the actuator housing 19 and a shaft mount 25 extends from the opposite end of the actuator housing 19 and receives a shaft collar 26, from which the actuator shaft 23 projects downwardly, essentially parallel to the sleeve pipe 10 and the mount pipe 15. As illustrated in FIG. 3, the drive shaft 24 is positioned concentrically inside the actuator shaft 23 and the top end of the drive shaft 24 extends into the actuator housing 19. Multiple gears 21 connect the top end of the drive shaft 24 to the motor shaft 22*a* of the electric motor 22, in order to effect rotation of the drive shaft 24 within the actuator shaft 23 at a suitable rotational speed. The drive shaft 24 projects through an internally threaded collar 31, which is fixed inside the actuator shaft 23 and the threaded collar 31 threadably receives the drive shaft threads 32 of a threaded segment of the drive shaft 24, such that rotation of the drive shaft 24 raises and lowers the actuator shaft 23, depending upon the direction of rotation of the electric motor 22, the gears 21 and the drive shaft 24. The actuator shaft 23 is attached to the top sleeve pipe plate 11 and the bottom sleeve pipe plate 12, respectively, by means of U-bolts 27 and cooperating nuts (not illustrated) and the bottom end of the drive shaft 24 is provided with a rounded drive shaft plate 30, which registers with a pair of upward-standing clevis mounts 28, that are welded or otherwise secured to the flat base plate 16. A mount pin 29 extends through horizontally-registering openings (not illustrated) provided in the clevis mount 28 and the drive shaft plate 30, in order to pivotally attach the extending lower end of the drive shaft 24 to the base plate 16.

Referring now to FIGS. 1–3 of the drawing, the adjustable basketball goal 1 is operated as follows: the backboard 2 and rim 3 are raised in concert along with the sleeve pipe 10, by operation of the linear actuator 18 from the position illustrated in FIG. 1 to the position illustrated in FIG. 2. Appropriate controls (not illustrated) attached to the wiring 20 of the actuator 18 for operating the electric motor 22 according to the knowledge of those skilled in the art, are manipulated to facilitate selective operation of the motor shaft 22*a* of the electric motor 22 in the clockwise and counterclockwise direction. When the motor shaft 22*a* is operated in the counterclockwise direction as viewed from the bottom in FIGS. 1—3, the gears 21 mesh and serve to rotate the drive shaft 24 in the counterclockwise direction and the drive shaft threads 32 engage the internal threads (not illustrated) provided in the fixed threaded collar 31, to force the actuator shaft 23, actuator housing 19 and the electric motor 22 upwardly with respect to the drive shaft 24. This operation elevates the sleeve pipe 10 on the mount pipe 15 and raises the backboard 2 and the rim 3, as illustrated in FIG. 2. If it is desired to then lower the backboard 2, rim 3 and the sleeve pipe 10 with respect to the mount pipe 15, the direction of rotation of the motor shaft 22*a* of the electric motor 22 is reversed by manipulating the controls in a reverse of the procedure noted above.

It will be appreciated by those skilled in the art that while the adjustable basketball goal 1 illustrated in the drawing utilizes a cylindrical sleeve pipe 10 and mount pipe 15, other support configurations, such as square tubing and channel-shaped members, in non-exclusive particular, may also be utilized, so long as the sleeve member is adapted to slidably traverse the underlying mount member. Furthermore, it will be also appreciated by those skilled in the art that the backboard 2 can be mounted to the top end of the sleeve pipe 10 in any desired manner, the technique illustrated in the drawing being illustrative only, and the mount pipe 15 may also be mounted to a movable frame or other structure which rests on the horizontal surface 17, to render the adjustable basketball goal portable, according to the knowledge of those skilled in the art. Moreover, referring again to FIGS. 1 and 2, both the mount pipe 15 and the sleeve pipe 10 can be mounted in angular relationship with respect to the horizontal surface 17, in order to extend the backboard 2 and rim 3 farther over a playing surface. The pivotal mounting of the drive shaft 24 to the base plate 16 at the drive shaft plate 30 facilitates mounting of the linear actuator 18 in functional configuration in this position of the adjustable basketball goal 1.

It will be further appreciated by those skilled in the art that alternative raising and lowering means other than the linear actuator 18, such as hydraulic or air cylinders and like apparatus, in non-exclusive particular, can be utilized to raise and lower the sleeve pipe 10, backboard 2 and rim 3. Under circumstances where the linear actuator 18 is used as the raising and lowering mechanism in the adjustable basketball goal 1, the linear actuator 18 may be characterized by an all-weather linear actuator manufactured by Thomson Saginaw Ball Screw Company of Saginaw, Michigan. Such linear actuators are used for positioning dish antennas and combine an electric motor, gearbox and precision ball screw assembly into a high-performance, electromechanical positioning device which is ideally suited for use in the adjustable basket ball goal of this invention. Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. An adjustable basketball goal comprising a fixed support attached to a supporting surface; a backboard support slidably carried by said fixed support; a backboard fixedly attached to said backboard support and a rim attached to said backboard; a pair of plates fixedly attached to said backboard support in spaced relationship; an actuator support shaft attached to said plates and an actuator drive shaft carried by said actuator support shaft in selectively extendible and retractable relationship, with the extending end of said actuator drive shaft pivotally attached to the supporting surface, whereby said backboard support, said backboard and said rim are adjustable with respect to the supporting surface responsive to operation of said actuator drive shaft.

2. The adjustable basketball goal of claim 1 further comprising backboard mount means having one end fixedly attached to said backboard support and the opposite end of said backboard mount means attached to said backboard, for mounting said backboard and said rim in spaced relationship with respect to said backboard support.

3. The adjustable basketball goal of claim 1 further comprising a base plate secured to the supporting surface and wherein said backboard support is fixedly attached to said base plate and said extending end of said drive shaft is pivotally attached to said base plate.

4. An adjustable basketball goal comprising a fixed support substantially vertically mounted on a horizontal surface; a backboard support slidably carried by said fixed support in concentric relationship; a backboard carried by said backboard support and a rim attached to said backboard; a pair of plates fixedly attached to said backboard support in spaced relationship; a linear actuator having a drive member with one end attached to the horizontal surface and a shaft member engaging said plates; and at least one U-bolt connecting said shaft member to said plates, said shaft member adapted to receive the opposite end of said drive member in extendible and retractable relationship, whereby said backboard support, said backboard and said rim are substantially vertically adjustable responsive to operation of said linear actuator and selective extension and reaction of said drive member with respect to said shaft member.

5. The adjustable basketball goal of claim 4 further comprising backboard mount means having one end fixedly attached to said backboard support and the opposite end of said backboard mount means attached to said backboard, for mounting said backboard and said rim in spaced relationship with respect to said backboard support.

6. The adjustable basketball goal of claim 4 further comprising a base plate secured to the supporting surface and wherein said fixed support is fixedly attached to said base plate and said extending end of said drive shaft is pivotally attached to said base plate.

7. A vertically adjustable basketball goal comprising a fixed support substantially vertically mounted on a horizontal surface; a backboard support slidably carried by said fixed support in concentric relationship; a backboard carried by said backboard support and a rim attached to said backboard; a pair of plates fixedly attached to said backboard support in spaced relationship; a linear actuator having a drive member attached to the horizontal surface and a shaft member lying against said plates; and a pair of U-bolts engaging said shaft member and said plates, respectively, for removably securing said shaft member to said plates, said shaft member receiving said drive shaft in threadable, extendible and retractable relationship, whereby said backboard support, said backboard and said rim are substantially vertically adjustable responsive to operation of said linear actuator and selective extension and retraction of said drive member with respect to said shaft member.

8. The vertically adjustable basketball goal of claim 21 further comprising a base plate secured to the supporting surface and wherein said fixed support is fixedly attached to said base plate and said extending end of said drive shaft is pivotally attached to said base plate.

9. The vertically adjustable basketball goal of claim 8 further comprising a backboard mount having one end fixedly attached to said backboard support and the opposite end of said backboard mount attached to said backboard, for mounting said backboard and said rim in spaced relationship with respect to said backboard support.

* * * * *